US009103533B1

(12) United States Patent
Shah

(10) Patent No.: US 9,103,533 B1
(45) Date of Patent: Aug. 11, 2015

(54) HIGH INTENSITY STUDIO LAMP AND METHOD USING A PLASMA SOURCE

(71) Applicant: Vylite LLC, Palo Alto, CA (US)

(72) Inventor: Binith R. Shah, Santa Monica, CA (US)

(73) Assignee: Vylite LLC, Palo Alto, CA (US)

( * ) Notice: Subject to any disclaimer, the term of this patent is extended or adjusted under 35 U.S.C. 154(b) by 127 days.

(21) Appl. No.: 13/710,403

(22) Filed: Dec. 10, 2012

Related U.S. Application Data

(60) Provisional application No. 61/568,613, filed on Dec. 8, 2011.

(51) Int. Cl.
*F21V 14/00* (2006.01)

(52) U.S. Cl.
CPC ..... *F21V 14/006* (2013.01)

(58) Field of Classification Search
USPC ..... 362/259
See application file for complete search history.

(56) References Cited

U.S. PATENT DOCUMENTS

| | | | | |
|---|---|---|---|---|
| 5,803,566 | A * | 9/1998 | Ogino | 353/60 |
| 2009/0180288 | A1* | 7/2009 | Mehlmann et al. | 362/373 |
| 2011/0181193 | A1* | 7/2011 | Jorgensen | 315/182 |

* cited by examiner

*Primary Examiner* — Laura Tso
(74) *Attorney, Agent, or Firm* — Richard T. Ogawa; Ogawa P.C.

(57) ABSTRACT

A studio lamp apparatus includes a housing structure including front and back ends, and an interior region between the front and back ends. The apparatus also includes a support structure coupled to the housing structure, which holds the housing structure in a suspended state. The apparatus includes a Fresnel lens coupled to the front end and a plurality of vents on the back end. The apparatus includes a lamp assembly within a portion of the interior region. The lamp assembly may have a reflector device operably coupled to a lamp device that has a resonator structure and a bulb including a fill material coupled to the resonator structure. The lamp device may also have an RF probe coupled to the bulb to supply power to the fill material and a focusing device between the Fresnel lens and the lamp assembly.

20 Claims, 4 Drawing Sheets

HIGH INTENSITY STUDIO LAMP AND METHOD USING A PLASMA SOURCE

CROSS-REFERENCES TO RELATED APPLICATIONS

The present invention is a non-provisional of Application No. 61/568,613 filed Dec. 8, 2011. This application is hereinby incorporated by reference, for all purposes.

STATEMENT AS TO RIGHTS TO INVENTIONS MADE UNDER FEDERALLY SPONSORED RESEARCH AND DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates generally to studio lighting. More particularly, the present invention provides a method and apparatus including a plasma lamp for efficient output of electromagnetic radiation for lighting and reliability. Merely by way of example, the present invention has been applied to a studio lamp including a Fresnel lens, but there can be others.

High-intensity studio lamps have many applications. They are widely used for stage light, movie shoots, photo shoots, television studio, major events, and other applications. In a conventional studio light, a bright 150 W to 1000 W quartz bulb is use for light generation. Unfortunately, conventional quartz bulbs are fundamentally based on incandescent technology, which has been around since the years of Thomas Edison and is not energy efficient. For example, for each watt of electricity used, such quartz bulb outputs less than 20 lumens of light. Most of the energy used by the quartz bulb, instead of being used to produce light, is converted to heat, which is generally undesirable.

Therefore, it is desirable to have energy efficient studio lamps.

BRIEF SUMMARY OF THE INVENTION

The present invention relates generally to studio lighting. More particularly, the present invention provides a method and apparatus including a plasma lamp for efficient output of electromagnetic radiation for lighting and reliability. Merely by way of example, the present invention has been applied to a studio lamp including a Fresnel lens, but there can be others.

According to the present invention, techniques related generally to studio lighting are provided. More particularly, the present invention provides a method and apparatus including a plasma lamp for efficient output of electromagnetic radiation. Merely by way of example, the present invention has been applied to a studio lamp including a Fresnel lens, but there can be others.

In a specific embodiment, the present invention provides a studio lamp apparatus. The apparatus includes a housing structure comprising a front end and a back end, and an interior region between the front end and the back end. The apparatus also includes a support structure coupled to the housing structure, which is configured to hold the housing structure in a suspended state. The apparatus includes a Fresnel lens coupled to the front end of the housing structure and a plurality of vents configured on the back end of the housing structure. The apparatus also has a lamp assembly configured within a portion of the interior region. In a preferred embodiment, the lamp assembly comprises a reflector device operably coupled to a lamp device. The lamp device has a resonator structure and a bulb comprising a fill material coupled to the resonator structure. In a preferred embodiment, the bulb has a maximum dimension of two centimeters and less. The lamp device also has an RF probe coupled to the bulb to supply power to the fill material to cause excitation leading to emission of electromagnetic radiation and a focusing device between the Fresnel lens and the lamp assembly to adjust a spot size of the emission of electromagnetic radiation.

According to another embodiment, the present invention provides a studio lamp apparatus. The apparatus includes a housing structure comprising a front end and a back end, and an interior region between the front end and the back end. The apparatus also includes a support structure coupled to the housing structure. The support structure is configured to hold the housing structure in a suspended state. The apparatus additionally includes a Fresnel lens coupled to the front end of the housing structure. Moreover, the apparatus includes a lamp assembly configured within a portion of the interior region. The lamp assembly includes a reflector device operably coupled to a lamp device. The lamp device comprises a resonator structure, a bulb comprising a fill material coupled to the resonator structure and having a maximum dimension of two centimeters and less, and an RF probe coupled to the bulb to supply power to the fill material to cause excitation leading to emission of electromagnetic radiation. The apparatus also includes a focusing device between the Fresnel lens and the lamp assembly to adjust a spot size of the emission of electromagnetic radiation. Moreover, the apparatus includes an driver module electrically coupled to the RF probe.

According to yet another embodiment, the present invention provides a studio lamp apparatus that includes a housing structure comprising a front end and a back end, and an interior region between the front end and the back end. The apparatus also includes a Fresnel lens coupled to the front end of the housing structure. Additionally, the apparatus includes a lamp assembly configured within a portion of the interior region. The lamp assembly comprises a reflector device operably coupled to a lamp device. The lamp device includes a resonator structure, a bulb comprising a fill material coupled to the resonator structure and having a maximum dimension of two centimeters and less, and an RF probe coupled to the bulb to supply power to the fill material to cause excitation leading to emission of electromagnetic radiation. The apparatus also includes a focusing device between the Fresnel lens and the lamp assembly to adjust a spot size of the emission of electromagnetic radiation. Also, the apparatus includes an driver module electrically coupled to the RF probe. Additionally, the apparatus includes a power module electrically coupled to the driver module, the power module being adapted to provide DC power to the driver module.

It is to be appreciated that embodiments of the present invention provides numerous advantages compared to conventional techniques. Studio lamps according the present invention are more efficient compared to conventional studio lamps. For example, a conventional studio lamp utilize incandescent bulbs having an efficacy of less than 20 lumens per watt. In contrast, studio lamps according to embodiments of the present invention can have a source efficacy of over 120 lumens per watt. For example, a studio lamp that consumes 95 W of electricity according to the present invention can produce enough light to replace a conventional 650 W studio lamp. In addition to energy savings, the lowered power consumption allows the studio lamp to be powered by battery modules. For example, a 50 WH battery (e.g., size of a laptop battery) can power a 95 W studio lamp according to the present invention for 30 minutes, which is long enough for many applications. In various embodiments, studio lamps according to the present invention are compatible with existing systems and can be mounted using existing mounting apparatus. In various embodiments, studio lamps can be powered by batteries due to the relatively low power consumption afforded by the plasma light source. With battery power, studio lamps according to embodiments of the present invention can be used in more applications and situations, where portability and flexibility are needed, compared to conventional studio lamp. There are other advantages as well.

DETAILED DESCRIPTION OF THE INVENTION

According to the present invention, techniques related generally to studio lighting are provided. More particularly, the present invention provides a method and apparatus including a plasma lamp for efficient output of electromagnetic radiation for lighting and reliability. Merely by way of example, the present invention has been applied to a studio lamp including a Fresnel lens, but there can be others.

As explained above, conventional studio lamps, which typically use incandescent quartz bulbs as light sources. Due to their innate inefficiency, most of the electricity used by the incandescent quartz bulbs are converted to heat, which is often undesirable. For example, to keep the temperature cool around the studio lamps, air conditioning units (which consumes even more energy) are necessary. To set up a location for a movie/photo shoot involving studio lamps usually means large electrical power lines are to be used to support electricity consumed by the studio lamps and air conditioning units. Another problem with inherent inefficiency of conventional studio lamp is that because quartz bulbs consume large amount of electricity, it is difficult to build portable studio lamps that run on batteries: small batteries do not have enough power to supply to the studio lamp, and large batteries are too heavy.

In the past few years, with advent of LED based light source, there have been attempts to build studio lamps that use LEDs as light source. Unfortunately, LEDs are not suitable for studio lamps. This is because individual LED chips do not generate enough light that can be used for studio lamps. To obtain enough lights from LEDs, multiple LEDs must be used together to aggregate the light they generate. However, having multiple LEDs is problematic for studio lamps, as multiple LEDs would usually require multiple reflectors (one for each LED chip) that result in undesirable multiple shadowing effects. Therefore, it is to be appreciated that embodiments of the present invention provide studio lamps that utilize plasma light source, which is both energy efficient and a point source that is suitable for studio lamp applications.

Figure 1:
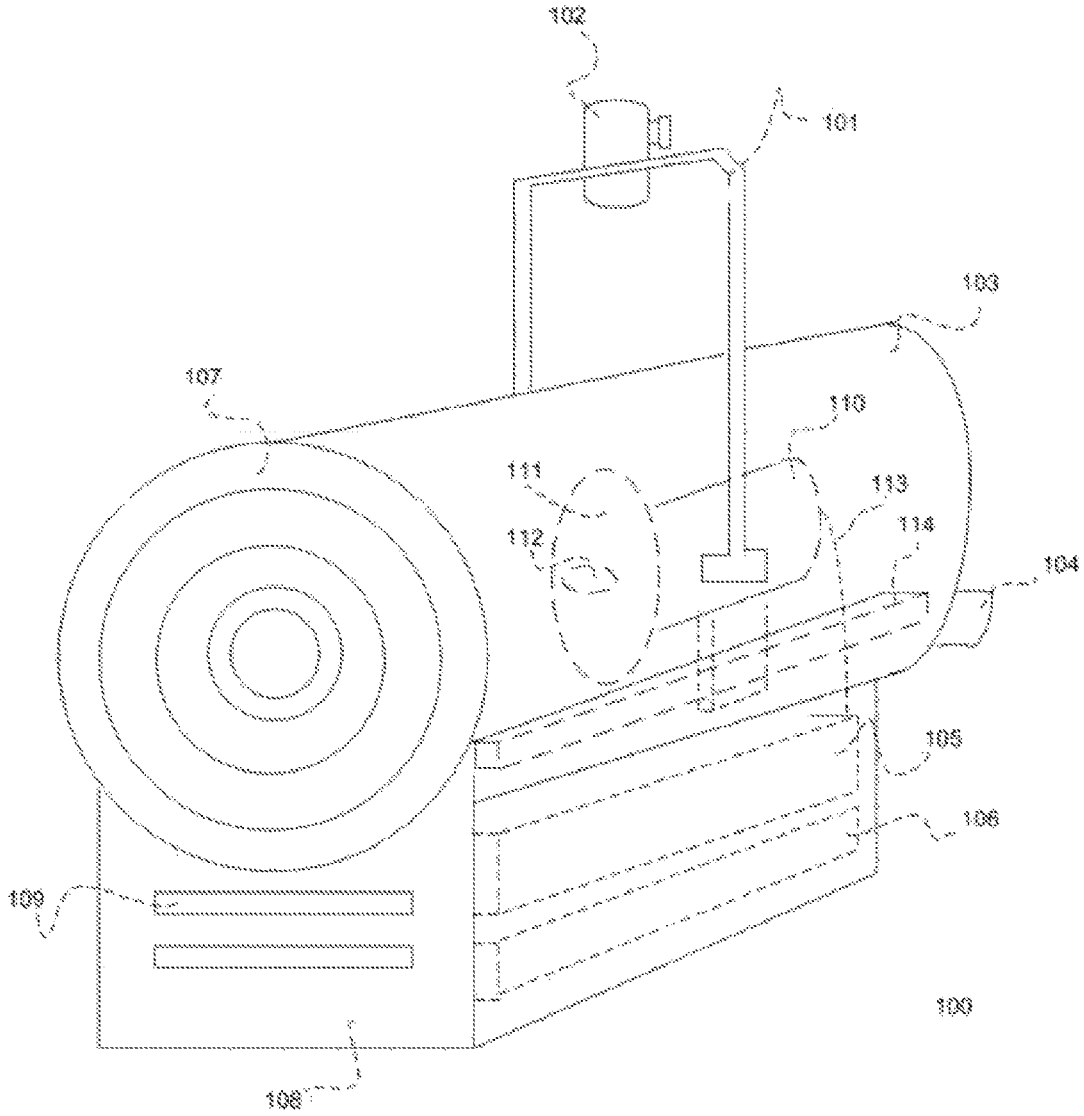
FIG. 1 is a simplified diagram of a perspective view of a studio lamp apparatus according to an embodiment of the present invention.

FIG. 1 is a simplified diagram of a perspective view of a studio lamp apparatus according to an embodiment of the present invention. This diagram is merely an example, which should not unduly limit the scope of the claims. One of ordinary skill in the art would recognize many variations, alternatives, and modifications. As shown in FIG. 1, a studio lamp 100 comprises a top housing 103 and a bottom housing 104. In various embodiments the top housing 103 and bottom housing 104 consists essentially of metal material, such as aluminum, steel, and/or others. It is to be appreciated that metal materials can be suitable for studio lamps as they are typically durable and have good thermal conductivity, which helps various electrical components inside to dissipate heat.

In various embodiments, the top housing 103 is operable coupled to the bottom housing 108, which allows the top housing 103 to open and expose the bulb 112 inside without being detached from the bottom housing 108.

In FIG. 1, various components inside the top housing 103 and the bottom housing 108 are shown in dashed lines. A plasma source assembly is positioned within the top housing 103. The plasma source assembly comprises a resonator 110, a reflector 111, and a bulb 112. The resonator 110 is electrically coupled to a driver 105, which is positioned within the bottom housing 108. The driver 105 is electrically coupled to a power module 106, which supplies DC power to the driver 105. Depending on the application, the power module 106 can be an AC/DC power converter or a battery. In a specific embodiment, power module 106 comprises an AC to DC power converter which converters 100 to 240V of AC power to DC power at about 24V. In certain embodiments, the power module 106 comprises 106 comprises a battery, which can supply at least 20 WH of power to the driver 105. For example, the power module is electrically coupled to an AC power source and/or a dimmer module (e.g., dimming module being able to provide an analog dimming signal at 10V range).

The power module 106 provides DC power to the driver 105. Depending on the specific application, the driver 105 may operates at about 95 W, 170 W, 350 W, or other power levels. For example, the operation of the driver 105 and the plasma lamp assembly is described in U.S. Pat. No. 7,291,985, titled "EXTERNAL RESONATOR/CAVITY ELECTRODE-LESS PLASMA LAMP AND METHOD OF EXCITING WITH RADIO-FREQUENCY ENERGY", which is incorporated by reference herein for all purposes.

The driver 105 draws power from the power module 106 to deliver electromagnetic energy to the resonator 110 via the cable 113. For example, the cable 113 is a co-axial cable that is semi-flexible. In various embodiments, the driver 105 is adapted to deliver power at various levels, thereby providing dimming control for the light emitted by bulb 112 and controlling overall system power consumption. In a specific embodiment, the driver 105 is adapted to change power delivered to the bulb 112 in response to wireless control signals.

In various embodiments, the driver 105 generates heat in operation. In certain embodiments, the driver 105 is thermally coupled to a heat sink that is capable to dissipate about 20 W to 60 W of heat. In a specific embodiment, the driver 105 is thermally coupled to the bottom housing 108, which dissipates heat generated by the driver. The bottom housing 108 is adapted to dissipate heat. The bottom housing 108 comprises air vents such as the opening 109 to dissipate heat. In certain embodiments, both the top housing 103 and the bottom housing 108 have texture surfaces that are optimized for black body heat emission.

The resonator 110 is configured to deliver power to the bulb 112, which in turn generates light. The bulb 112 comprises a substantially transparent outer wall that is capable of withstand a high temperature. For example, the bulb 112 can operate at a temperature of over 600 degree Celsius. Depending on the application, the bulb wall may be made of quartz, ceramic, or other types of material. The bulb 112 is electrodeless and comprises various types of gaseous species. In operation, the gaseous species inside the bulb 112 heats up into a plasma state and emit light. Depending on the gaseous species inside, the bulb 112 can be adapted to generate light in various color and/or color temperature. For example, the bulb 112 is specific configured to generate light that matches various conditions, such as day light, shade, tungsten light, florescent, and others.

Since the bulb 112 is powered by RF energy, the bulb 112 may produce electromagnetic interference (EMI). In various embodiments, portion of the top housing 103 comprises conductive mesh material that is configured to shield the EMI generated by the bulb 112. The bulb 112 can have a life of over 50,000 hours, which is greater than the typical 200 hours afforded by conventional incandescent quartz bulbs that average about 200 hours of life time. The longer life of the bulb 112 translates to lower maintenance costs and greater convenience.

It is to be appreciated that the bulb 112 can be easily replaced. In various embodiments, the bulb 112 is coupled to the resonator 110 by screwing, and can be easily screwed off. It is to be appreciated that by replacing the bulb 112, color temperature can be adjusted. For example, depending on the filling within the bulb 112, the color temperature can be from 2000 k to 7000 k, which far exceeds color temperature range of incandescent bulbs (for LEDs to adjust color temperature at such range, a large percentage of efficiency is lost).

The reflector 111 is positioned behind the bulb 112. The reflector 111 is configured to direct light generated by the bulb 112 toward to optical element 107. In various embodiments, the reflector 111 consists essentially of conductive material and functions as an EMI shield. For example, being electrically conductive, the reflector 111 prevents electromagnetic radiation generated by the bulb 112 from spreading behind the reflector. Depending on the application, the reflector 111 can be made with metal materials such as aluminum, steel, and/or others.

As described above, the bulb 112, reflector 111, and the resonator 110 together form a plasma lamp assembly. The plasma lamp assembly is operable coupled to the guide rail 114. By operating (e.g., turning, pulling, etc.) the knob 104, the plasma lamp assembly can be moved along the guide rail 114 and changing its relative position to the optical element 107. For example, the optical element 107 output relatively more concentrated light when the plasma lamp assembly is close to the optical element 107; the optical element 107 outputs relative more diffused light when the plasma lamp assembly is far from the optical element 107. A user is able to change to light output studio lamp 100 by operating the knob 104. In various embodiments, the optical element 107 comprises a Fresnel lens. In a specific embodiment, a conductive mesh is provided in front of the optical element 107 to protect the element 107 and to provide a shield for EMI generated by the driver 105 and the bulb 112.

The studio lamp 100 can be mounted in various ways. For example, the bottom housing 108 has a flat surface at the bottom, which allows the studio lamp 100 to sit on a flat surface. The studio lamp 100 also comprises a bracket 101 that can be used as a handle bar for carrying the studio lamp. In addition, the bracket 101 is coupled to a socket 102, which can be attached to various types of mounting mechanisms.

Figure 2:
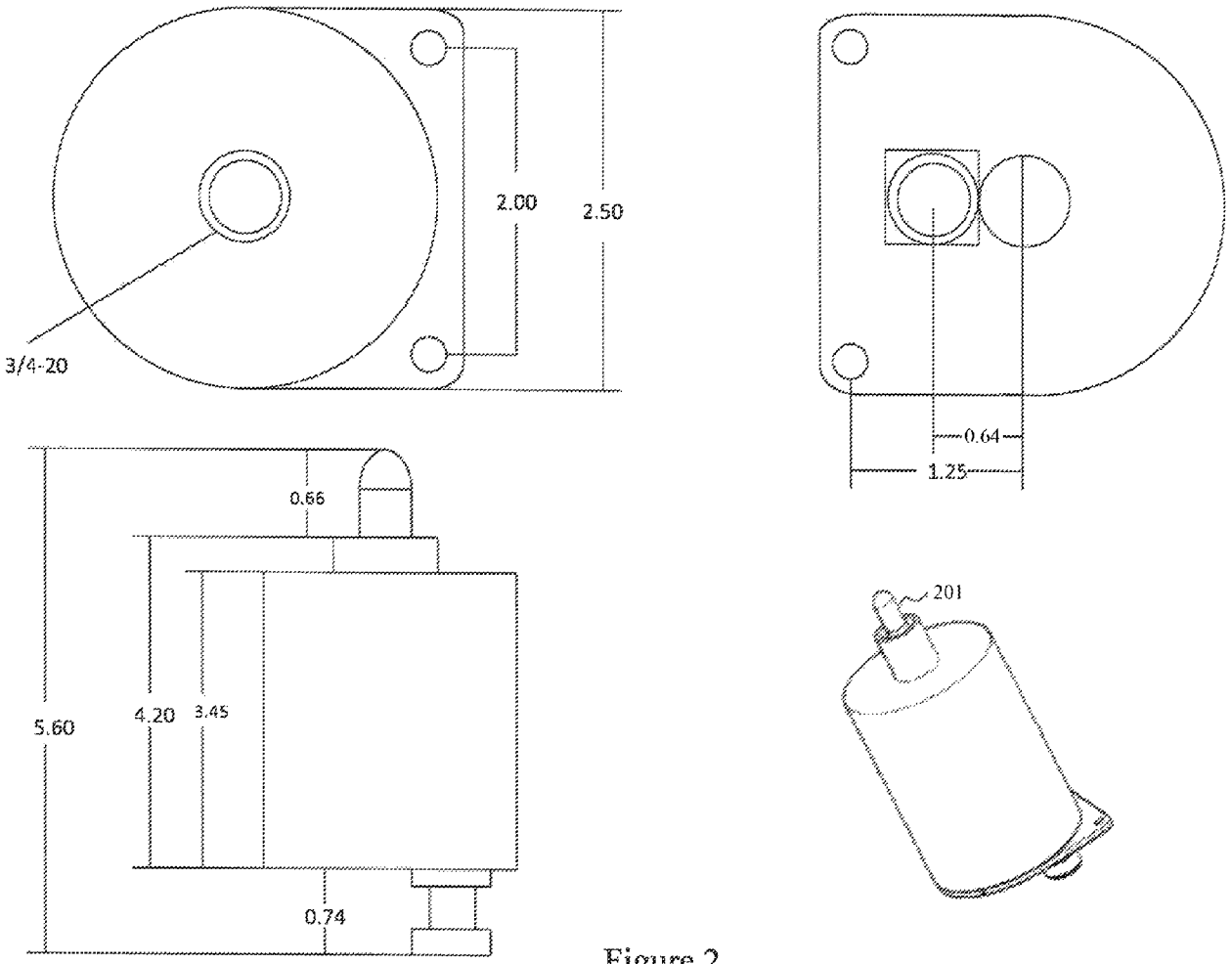
FIG. 2 is a simplified diagram of a first side view of a resonator and bulb assembly according to an embodiment of the present invention.

FIG. 2 is a simplified diagram of a first side view of a resonator and bulb assembly according to an embodiment of the present invention. This diagram is merely an example, which should not unduly limit the scope of the claims. One of ordinary skill in the art would recognize many variations, alternatives, and modifications. For example, the resonator/bulb assembly has a total length of less than 6 inches and a width of about 2.5 inches. For example, the resonator/bulb assembly is secured within the top housing 103 shown in FIG. 1. The bulb as shown in FIG. 2 has an exposed length of about 0.66 inch and can have a total length of about less than 1 inch. It is to be appreciated the small size, as compared to conventional 150 W to 1000 W quartz bulb used in studio lamps, of the bulb allows the reflector and other optical elements of the lamp 100 to be small in sizes. In FIG. 2 the bulb is provided at the top side of the resonator, and a connector is provided on the bottom side (opposite of the top side) of the resonator. For example, the connector is adapted for electrically coupling to a coaxial cable. It is to be appreciated that the resonator/bulb assembly can have other sizes and shapes as well. As shown in FIG. 2, the bulb is attached to resonator through an RF probe 201.

Figure 3:
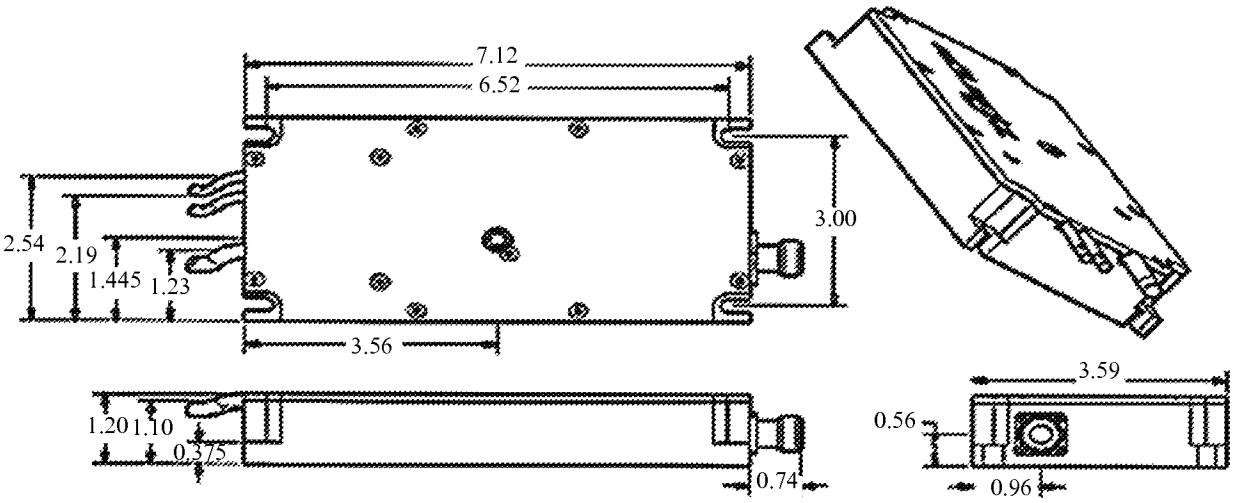
FIG. 3 is a simplified diagram of a driver module according to an embodiment of the present invention.

FIG. 3 is a simplified diagram of a driver module according to an embodiment of the present invention. This diagram is merely an example, which should not unduly limit the scope of the claims. One of ordinary skill in the art would recognize many variations, alternatives, and modifications. The driver module is configured to house one or more electronic control units. In various embodiments, the resonator assembly comprises an RF driver board and a controller module. The housing of the driver module is adapted to function as a heat sink for the RF driver board and the controller module. In various embodiments, the housing of the driver module comprises conductive metal material that functions a shield that prevents EMI generated by the RF module.

Figure 4:
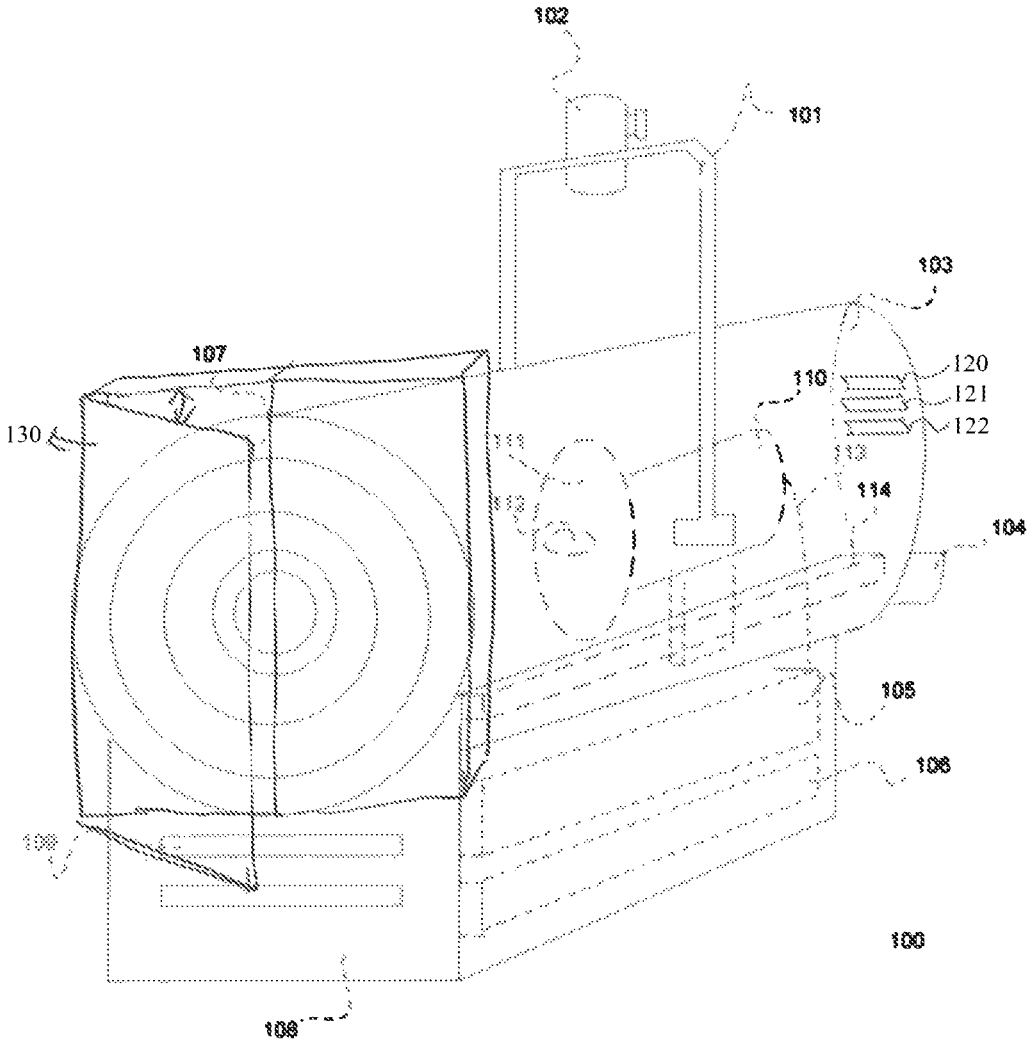
FIG. 4 is more detailed diagram of various elements of the aforementioned studio lamp according to an embodiment of the present invention.

FIG. 4 is more detailed diagram of various elements of the aforementioned studio lamp according to an embodiment of the present invention. This diagram is merely an example, which should not unduly limit the scope of the claims. One of ordinary skill in the art would recognize many variations, alternatives, and modifications. A shown in FIG. 4, vents 120, 121, and 122 configured on the back end of the housing structure.

It is to be appreciated that other variations are possible as well under the scope of present application.

What is claimed is:

1. A studio lamp apparatus, comprising:

a housing structure comprising a front end and a back end, and an interior region between the front end and the back end;

a support structure coupled to the housing structure, the support structure being configured to hold the housing structure in a suspended state;

a Fresnel lens coupled to the front end of the housing structure;

a plurality of vents configured on the back end of the housing structure;

a lamp assembly configured within a portion of the interior region, the lamp assembly comprising a reflector device operably coupled to a lamp device, the lamp device comprising:

a resonator structure;

a bulb comprising a fill material coupled to the resonator structure, the bulb having a maximum dimension of two centimeters and less;

an RF probe coupled to the bulb to supply power to the fill material to cause excitation leading to emission of electromagnetic radiation; and a focusing device between the Fresnel lens and the lamp assembly to adjust a spot size of the emission of electromagnetic radiation.

2. The apparatus of claim 1 further comprising a controlling module configured to send control signals to the RF probe, the RF probe being adapted to supply power at different power levels in response to the control signals, the control signals being generated in response to changes in analog power input.

3. The apparatus of claim 1 further comprising a coaxial cable coupled to the RF resonator structure and RF probe.

4. The apparatus of claim 1 further comprising a wireless receiving module coupled to the RF probe, the wireless receiving module being configured to provide control signals to the RF probe.

5. The apparatus of claim 1 further comprising conductive structure positioned within a 10 cm vicinity of the bulb, conductive structure being adapted to the emission of electromagnetic radiation.

6. The apparatus of claim 1 wherein the Fresnel is characterized by a diameter of less than 6 cm.

7. The apparatus of claim 1 further comprising a coupling structure positioned on a surface of the housing structure, the coupling structure being adapted to mounting a power converting module and/or a battery module.

8. The apparatus of claim 1 wherein the RF probe is thermally coupled to the housing structure and dissipate at least 30 W of heat.

9. The apparatus of claim 1 further comprising a light modifying device configured on the front end of the housing, the light modifying device comprising a plurality of movable members configured as a barn door structure.

10. The apparatus of claim 1 wherein the focusing device comprises at least one track configured to move the lamp assembly relative to the Fresnel lens, the Fresnel lens being fixed on the front end of the housing.

11. The apparatus of claim 1 wherein the focusing device comprises at least one track configured to move the Fresnel lens relative to the lamp assembly.

12. The apparatus of claim 1 wherein the emission of electromagnetic radiation is at least 10,000 lumens.

13. The apparatus of claim 1 wherein the emission of electromagnetic radiation is at least 5,000 lumens.

14. The apparatus of claim 1 wherein the emission of electromagnetic radiation is characterized by a color spectrum ranging from about 2500 k to about 7000 k.

15. A studio lamp apparatus, comprising:

a housing structure comprising a front end and a back end, and an interior region between the front end and the back end;

a support structure coupled to the housing structure, the support structure being configured to hold the housing structure in a suspended state;

a Fresnel lens coupled to the front end of the housing structure;

a lamp assembly configured within a portion of the interior region, the lamp assembly comprising a reflector device operably coupled to a lamp device, the lamp device comprising a resonator structure, a bulb comprising a fill material coupled to the resonator structure and having a maximum dimension of two centimeters and less, and an RF probe coupled to the bulb to supply power to the fill material to cause excitation leading to emission of electromagnetic radiation;

a focusing device between the Fresnel lens and the lamp assembly to adjust a spot size of the emission of electromagnetic radiation; and an driver module electrically coupled to the RF probe.

16. The apparatus of claim 15 further comprising an AC/DC converter electrically coupled to the RF probe.

17. The apparatus of claim 15 further comprising a battery electrically coupled to the RF probe.

18. The apparatus of claim 15 further comprising an EMI shield positioned around the lamp assembly.

19. A studio lamp apparatus, comprising:

a housing structure comprising a front end and a back end, and an interior region between the front end and the back end;

a Fresnel lens coupled to the front end of the housing structure;

a lamp assembly configured within a portion of the interior region, the lamp assembly comprising a reflector device operably coupled to a lamp device, the lamp device comprising a resonator structure, a bulb comprising a fill material coupled to the resonator structure and having a maximum dimension of two centimeters and less, and an RF probe coupled to the bulb to supply power to the fill material to cause excitation leading to emission of electromagnetic radiation;

a focusing device between the Fresnel lens and the lamp assembly to adjust a spot size of the emission of electromagnetic radiation;

an driver module electrically coupled to the RF probe; and a power module electrically coupled to the driver module, the power module being adapted to provide DC power to the driver module.

20. The apparatus of claim 19 wherein the reflector device is adapted to shield EMI emitted by the bulb.

* * * * *